United States Patent [19]

Justus

[11] 4,140,574

[45] Feb. 20, 1979

[54] WEB SPREADER AND GUIDE

[75] Inventor: Edgar J. Justus, Beloit, Wis.

[73] Assignee: Beloit Corporation, Beloit, Wis.

[21] Appl. No.: 889,868

[22] Filed: Mar. 24, 1978

[51] Int. Cl.[2] ..... D06C 3/06; D21F 1/32; D21F 1/36

[52] U.S. Cl. ..... 162/257; 74/241; 162/273; 162/275

[58] Field of Search ..... 162/257, 274, 275, 273, 162/199; 74/240, 241; 26/78; 226/180; 210/DIG. 3

[56] References Cited

U.S. PATENT DOCUMENTS

| | | | |
|---|---|---|---|
| 2,530,122 | 11/1950 | Hornbostel | 74/241 |
| 2,635,475 | 4/1953 | Hornbostel | 74/241 |
| 2,718,156 | 9/1955 | Wright | 74/241 |
| 2,752,657 | 7/1956 | Meneo | 26/78 |
| 2,772,879 | 12/1956 | Lorig | 74/241 X |
| 2,801,102 | 7/1957 | Walter et al. | 74/241 X |
| 3,310,210 | 3/1967 | Reib | 226/180X |
| 4,007,865 | 2/1977 | Crandall | 226/180 X |

*Primary Examiner*—Richard V. Fisher

*Attorney, Agent, or Firm*—Hill, Gross, Simpson, Van Santen, Steadman, Chiara & Simpson

[57] ABSTRACT

A web spreading and guiding device to maintain a running paper sheet making foraminous web comprising a wire or pick-up felt transversely taut and straight running in a papermaking machine, has a pair of free running pneumatic tires having their treads in nipping relation to one another to engage a margin of the web in the nip, the tires being carried by an arm which is pivotally biased to effect transverse web stretching bias of the tires on the web margin running through the nip. Generally one of the devices will be mounted to act on one margin of the web and another of the devices on the opposite margin of the web and the devices being cooperatively biased to stretch the web in opposite directions. Means are provided to control the tire bias for correcting any deviations of the web from a straight running path.

17 Claims, 4 Drawing Figures

WEB SPREADER AND GUIDE

This invention relates to a new and improved web spreading and guiding device, and is more particularly concerned with such a device especially suitable for maintaining a running paper sheet making foraminous web transversely taut and straight running in a papermaking machine.

Papermaking webs which may comprise a wire or pickup felt and running at high speed have a tendency to stretch longitudinally and contract in width, and from time to time may tend to deviate laterally from a straight path. Heretofore various expedients have been proposed to alleviate this problem. For example in U.S. Pat. No. 2,530,122 an arrangement is disclosed wherein a guide roller is adjustably mounted to control the running web for a straight line running. In U.S. Pat. No. 2,752,657 an arrangement of elongated pinch rollers is provided along opposite margins of the web for not only maintaining the web transversely spread or taut, but also for correcting deviations from a straight line of travel. Whereas the web guiding roll does not provide for spreading the web, the marginal pinch roll arrangement does provide for spreading but presents certain other problems.

One of the problems encountered with the marginal pinch roll spreader and guide arrangements is that the bearings for the pinch rolls are undesirably exposed to the necessarily wet environment of the papermaking web and therefore frequently fail. Another difficulty experienced with the elongated marginal pinch rolls is that by virtue of the location in the fairly critical area adjacent the headbox slice there has been some tendency for globs of matter such as accumulated paper stock or drops of water to be flung from the pinch rolls into the stock jet issuing from the slice.

It is therefore an object of the present invention to overcome the disadvantages, drawbacks, inefficiencies, shortcomings and problems inherent in prior web spreaders and guides by providing a new and improved web spreading and guiding device.

Another object of the invention is to provide a new and improved web spreading and guiding device of simple, rugged, compact construction which is especially reliable and efficient for maintaining a running paper sheet making foraminous web such as a wire or pickup belt transversely spread or taut and straight running in a papermaking machine.

According to features of the invention there is provided in a web spreading and guiding device to maintain a running paper sheet making web comprising a foraminous wire or a pickup felt spread and straight running in a papermaking machine, a carrying arm, a supporting structure, means pivotally mounting the arm on the supporting structure adjacent to one margin of the web for swinging adjustment about an axis extending substantially normal to the plane of the web, a pair of pneumatic tires, means mounting said tires on said arm to rotate freely on axes which extend in a direction substantially parallel and transversely relative to said web, said tires having treads in nip relation to one another and engaging said web margin in said nip, means for maintaining said tires inflated to effect a desired nip pressure, and means for biasing said arm and thereby said tires to effect a nip bias on said margin in a transverse web spreading direction.

Other objects, features and advantages of the invention will be readily apparent from the following description of a certain representative embodiment thereof, taken in conjunction with the accompanying drawings although variations and modifications may be effected without departing from the spirit and scope of the novel concepts embodied in the disclosure and in which.

Figure 1:
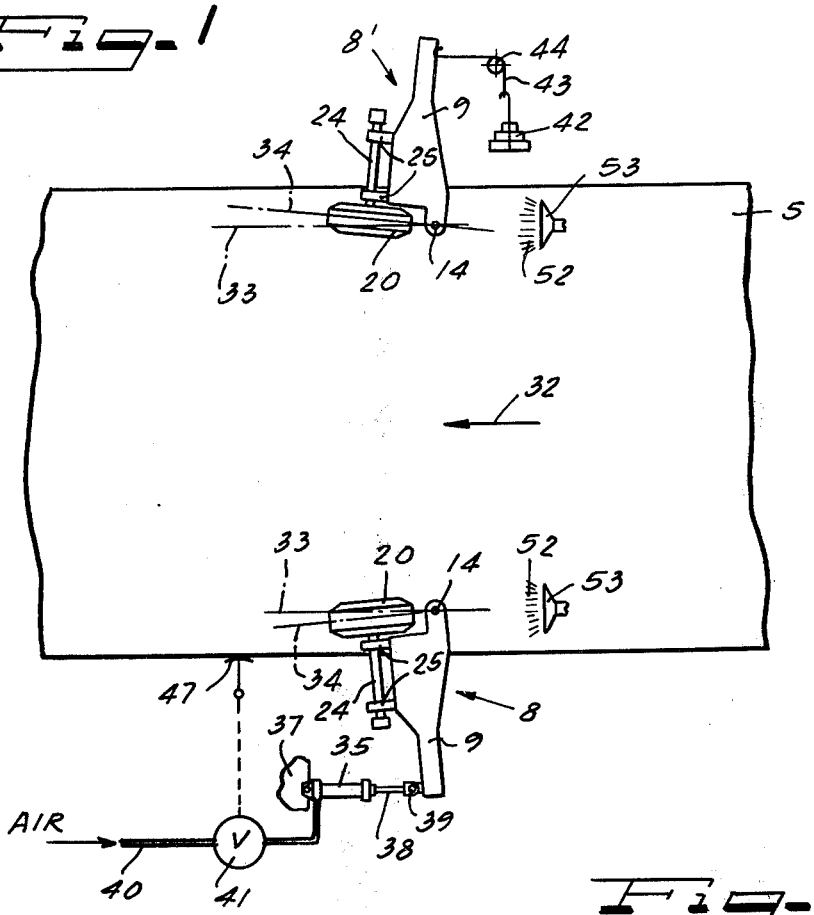
FIG. 1 is a schematic top plan view of a web showing web spreading and guiding devices embodying features of the invention.

On reference to FIG. 1, a paper sheet making web which may comprise a foraminous wire or a pickup felt is maintained spread and straight running in a papermaking machine 7 (FIG. 2) by means of a web spreading and guiding device 8 along one margin and a cooperating similar spreading and guiding device 8′ along the opposite margin. Since the device 8 and 8′ embody substantially the same structure but oriented in allochiral relation, a detailed description of one of the devices will suffice for both to the extent of their similarities.

Figure 4:
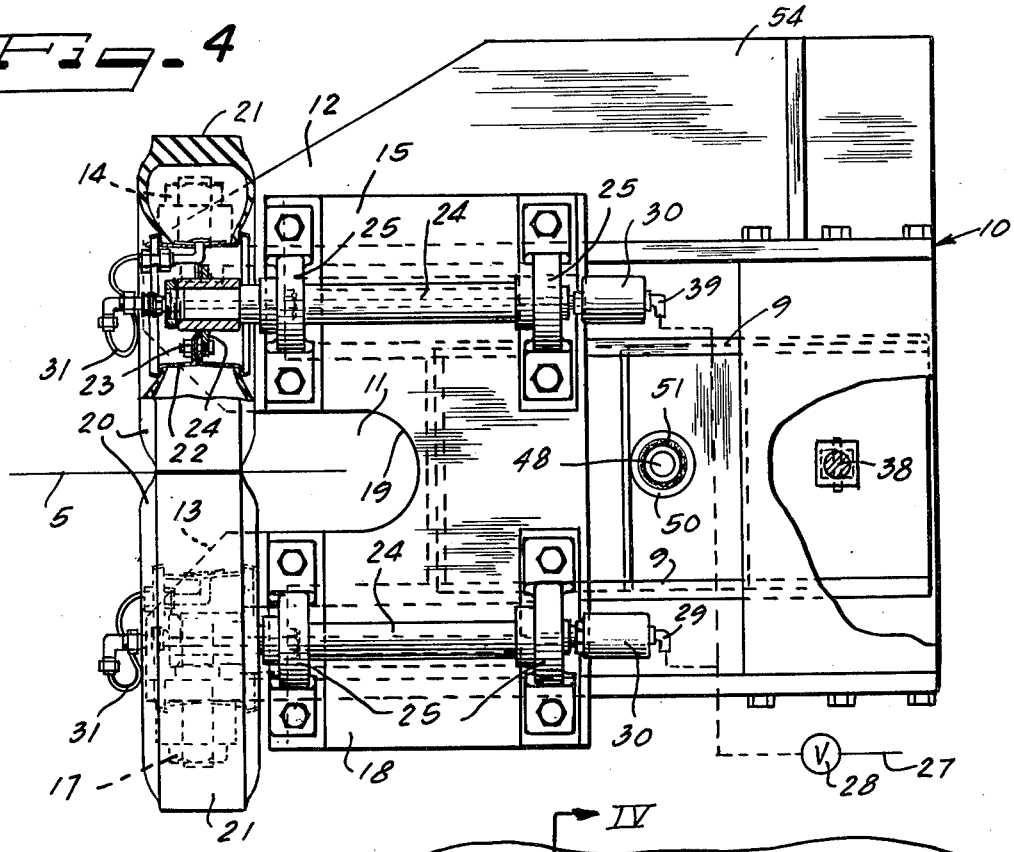
FIG. 4 is a vertical sectional detail view taken substantially in the plane of line IV—IV of FIG. 3.

Each of the devices 8 and 8′ comprise a carrying arm 9 and a supporting structure 10 (FIGS. 2–4) mounted on the frame of the machine 7 in such a position adjacent to one margin of the web 5 that such margin is received through a clearance between a supporting structure projection 12 opposite one face of the web margin and a similar supporting structure projection 13 opposite the opposite face of the web margin. Through this arrangement castering pivotal connection of the arm 9 to the supporting structure 10 is enabled by means of a pivot 14 pivotally connecting one branch 15 of the arm to adjacent the extremity of the projection 12, and pivotal connection by means of a pivot 17 of a branch 18 to adjacent the extremity of the supporting projection 13. To receive the margin of the web 5 between the arms 15 and 18, they are provided with a clearance recess 19. As will be observed, the pivotal mounting of the arm 9 adapts it for swinging adjustment about an axis extending substantially normal to the plane of the web 5.

Essential to the performance of each of the devices 8 and 8′ is a pair of pneumatic tires 20 which have treads 21 in nip relation to one another and engaging the margin of the web 5 in the nip. In the best mode, the tire treads 21 are smooth so that the web 5 is engaged without creasing or indentation. Means for mounting the pneumatic tires 20 on the arm 9 to rotate freely on axes which extend in a direction substantially parallel and transversely relative to the web 5 comprise respective wheel members 22 on which the tires 20 are mounted in a suitable fashion, such as in the manner customary with mounting of tubeless tires. Hubs of the wheels 22 are attached demountably as by means of bolts 23 to respective attachment flanges 24 corotatively carried on respective axle shafts 24. Each of the shafts 24 is journaled in a pair of spaced bearings 25 mounted on the arm 9, one set of shaft and bearings being mounted on the arm branch 15 and the other set on the arm branch 18.

Means are provided for inflating the tires 20 from an uninflated condition wherein threading of the web 5 between the tires is facilitated to a preferred inflation pressure to effect a desired nip pressure and maintaining the pressure substantially constant during operation of the device. In a preferred construction, tire inflation is effected from a suitable source such as a compressed air tank through a pressure line 27 through a control valve 28 connected by suitable branch ducts 29 through rotary seal assemblies 30 to outer ends of the shafts 24 which are hollow for this purpose and are connected at their tire supporting ends through respective ducts 31 communicating through the wheels 22 with the interior of the tires 20.

Figure 2:
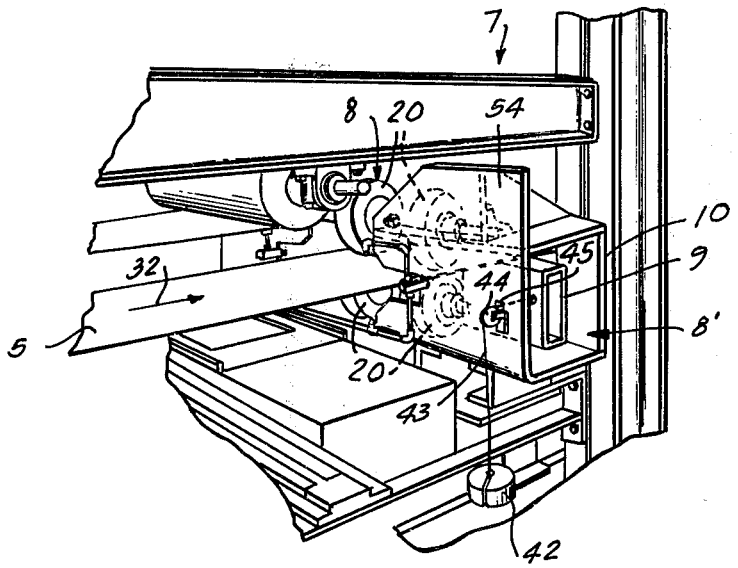
FIG. 2 is a fragmentary perspective view of papermaking machine apparatus showing web spreading and guiding devices according to the present invention mounted therein.
Figure 3:
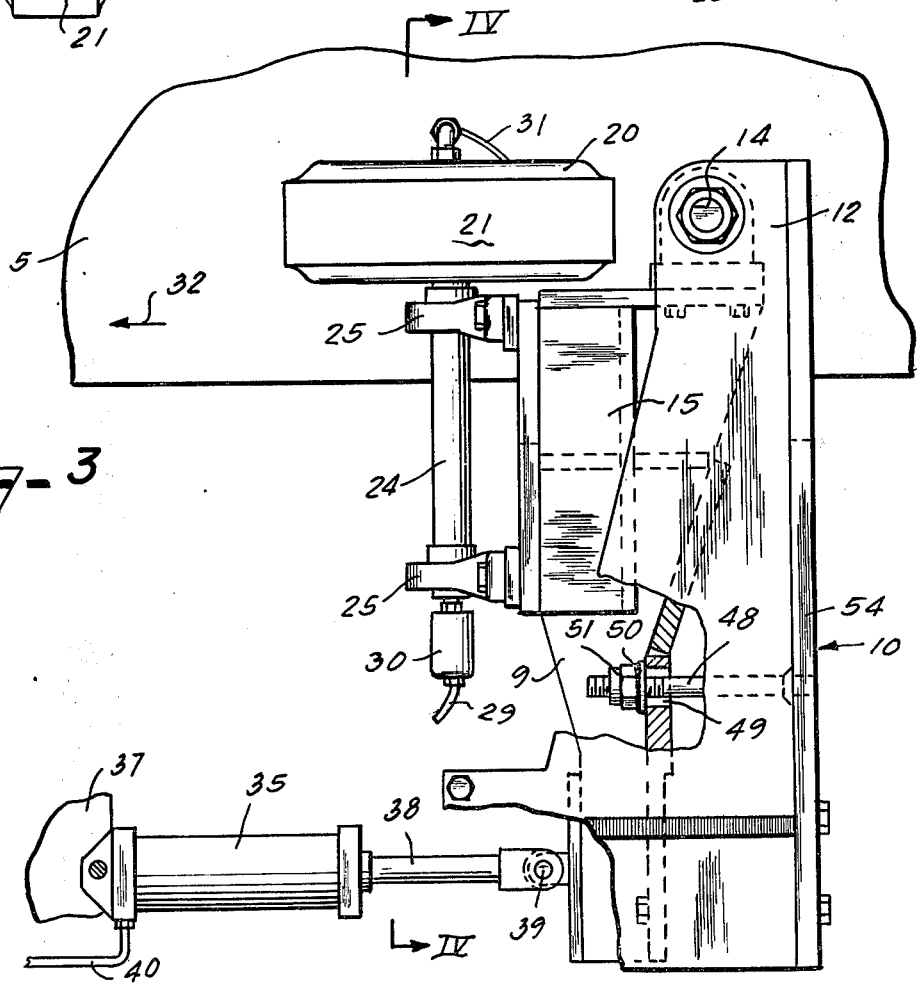
FIG. 3 is an enlarged top plan view of one of the web spreading and guiding devices.

Mounting of the tires 20 is such that they are forwardly in line with the pivots 14 and 17 having regard to the direction of travel of the web 5, indicated by the arrow 32 in FIGS. 1, 2 and 3. Thereby, the tires 20 are adapted to caster straight ahead in the straight running of the web 5, substantially as indicated by the straight parallel lines 33 in FIG. 1. However, at start up the web 5 may not be properly transversely taut or stretched. Also, during operation there may be a tendency for the web to contract transversely. To counteract any tendency for the web 5 to be less than properly spread during operation, means are provided for biasing the arm 9 of each of the devices 8 and 8' and thereby the tires 20 to effect a nip bias on the engaged margin of the web in a transverse web spreading direction. That is the nip of the tires 20 of the device 8 is biased toward the adjacent edge of the web 5 and the nip of the tires 20 of the device 8' is biased toward the edge of the web 5 which is adjacent to that device. In a preferred arrangement, about a 5° adjustable bias is imparted to each of the tire nips, as represented by the line 34 in each instance in FIG. 1. One desirable biasing means comprises an air cylinder 35 mounted at one end on a stationary support 37 which may comprise a part of the papermaking machine 7. A piston rod 38 extends from the opposite end of the air cylinder 35 and is pivotally connected as at 39 to the distal end portion of the arm 9 in a manner to bias the arm 9 about its pivot to bias the tires 20 and thereby the nip of the tires toward the bias direction 34. Air under suitable pressure may be supplied to the air cylinder 35 from source through a conduit 40 under the control of a valve 41. Although both of the units 8 and 8' may be equipped with the air cylinder actuator type of biasing means, in a desirable arrangement only one of the devices is equipped with the air cylinder biasing means, herein the device 8, while the other device 8' is equipped with a static weight biasing means (FIGS. 1 and 2) comprising a weight 42 suspended from a flexible connector 43 such as a cord or wire which is connected at its opposite end to the distal end portion of the associated arm 9 and is conveniently tained over a pulley 44 which may be mounted on the supporting structure 10 at the other side of a hole 45 whereby the pull on the flexible element 43 is in a direction to effect bias of the associated tires 20 toward the nip bias direction 34. As a result, there is a constant nip bias of the tires 20 maintaining the running web 5 spread even though during high speed running the tires 20 may caster to substantially the straight running lines 33.

As the web 5 runs at high speed, slight inaccuracies and tolerances, stresses, tension variations, and the like, may cause the web 5 to deviate to either side. To correct such deviation and guide the web 5 automatically into the desired straight path, means are provided for operating the pneumatic actuator 35 to control the bias of the tires 20 of the device 8, the device 8' automatically adjusting in generally slave relation. For this purpose a feeler or detector paddle 47 is appropriately mounted along the edge of the web 5 near the device 8 and is connected to the valve 41 to operate the valve either to direct air to the pneumatic actuator 35 or to bleed air therefrom. The detector paddle 47 may be on the order of those described for substantially similar purpose in U.S. Pat. Nos. 2,530,122 and 2,635,475, and to any extent necessary those patents are incorporated herein for reference as to this detector paddle feature and air valve control. Should the web 5 misalign or deviate toward the detector paddle 47, the valve 41 is controlled to bleed air from the cylinder 35 and thus inactivate the nip bias of the device 8 at least to the extent necessary to effect necessary correction and straightening of the web 5. As the nip bias of the device 8 is relaxed, the biasing weight 42 continues its bias of the device 8' which is thus free to increase biasing effect of the associated tire nip and urge the web 5 toward the device 8' until the web has attained substantially straight running orientation which is detected by the detector paddle 47 which effects opening of the valve 41 to again apply pneumatic bias through the actuator 35 on the arm 9 of the device 8 to attain equalized spreading bias of the devices 8 and 8' on the web 5. On the other hand, should the web 5 deviate out of alignment in the direction of the device 8', the detector paddle 47 will also detect such deviation, and operate the valve 41 to increase the pneumatic biasing load through the actuator 35 on the arm 9 of the device 8 whereby to increase the biasing effect of the tires 20 of the device 8 sufficiently to effect correction and guide the web 5 to return to the straight orientation. Accordingly, the web 5 is automatically maintained continuously straight running and thoroughly spread.

To enhance the automatic, efficient straight guiding of the web 5, means are provided in respect to each of the devices 8 and 8' to prevent toeing in of the tires 20 while permitting the tires to toe out as is desirable for their web spreading function. In a simple form, the inward toe in preventing means comprise a rigid elongate member 48 such as a bolt securely fastened as by welding to the supporting structure 10 and extending through a clearance opening 49 in the associated arm 9, with a stop 50 adjusted as by means of a nut 51 welded thereto to proper stopping location on the bolt 48 to maintain the arm against swinging to a position where the associated tires 20 may toe in.

In operation, the web 5 is threaded between the tires 20 of each of the devices 8 and 8' while the tires are deflated. Then the tires are inflated to effect nipping engagement of the associated margins of the web 5 and the web 5 placed in running order with the devices 8 and 8' automatically maintaining spreading nip bias and effecting guiding correction of the running web when any lateral deviation from a substantially straight path is detected.

During high speed operation, and due to the normal spreading bias imparted to the tire nips, the tire treads 21 may tend to heat and thus affect the air pressure in the tires, although a constant nip pressure is desirable. To alleviate undesirable heating of the tires, cooling water spray 52 is applied as by means of a fan spray nozzle 53 upstream from each of the sets of tires 20. Thereby only the minimum of water film desirable for cooling the tires will be carried by the web 5 to the tires and there will be minimal if any tendency for water to be splashed or projected from the tires forwardly, thereby avoiding any detrimental affects that might otherwise be encountered if cooling water were applied to the tires in a manner which might result in significant amount of water being splashed or projected forwardly. Another beneficial effect of the fan sprays 52 on the marginal areas of the web 5 engaged by the tires 20 in a papermaking machine environment is that any papermaking stock that may migrate to these areas or remain with these areas in the cycling of the endless belt 5 is washed from the belt by the spray showers before any such stock particles can come into contact with the tires. This eliminates possibility of the stock particles being projected by the tires forwardly toward or into the stock stream or back onto the inner area of the web 5 where such particles might be deleterious to subsequent formation of paper sheet on the web.

It may also be noted that by having the bearings 25 for the rotary tire shafts 24 located substantially laterally outwardly from the tires 20 and thus substantially away from the paper forming area of the web 5, the bearings are substantially away from the normally wet environment associated with papermaking webs. Further, by having the backs of the supporting structures 10, which are located upstream from the tires 20 and the bearings 25 in the form of a plate or panel 54, a substantial protective shield is provided against water splash carried forwardly by the rapidly travelling web 5. Additional protection against water access to the bearings 25 may easily be provided if desired.

It will be understood that variations and modifications may be effected without departing from the spirit and scope of the novel concepts of this invention.

I claim as my invention:

1. In a web spreading and guiding device to maintain a running paper sheet making web comprising a foraminous wire or a pickup felt spread and straight running in a papermaking machine:

a carrying arm;

a supporting structure;

means pivotally mounting the arm on the supporting structure adjacent to one margin of the web for swinging adjustment about an axis extending substantially normal to the plane of the web;

a pair of pneumatic tires;

means mounting said tires on said arm to rotate freely on axes which extend in a direction substantially parallel and transversely relative to said web;

said tires having treads in nip relation to one another and engaging said web margin in said nip;

means for maintaining said tires inflated to effect a desired nip pressure;

and means for biasing said arm and thereby said tires to effect a nip bias on said margin in a tranverse web spreading direction.

2. A device according to claim 1, wherein said means pivotally mounting the arm are located upstream substantially in alignment with the tires relative to the direction of running travel of the web, whereby the tires are adapted to caster in running relation on the margin of the web.

3. A device according to claim 2, wherein said arm extends a substantial distance from said pivotal mounting means and beyond the margin of the web, and said means for biasing said arm being connected to the distal end portion of the arm.

4. A device according to claim 2, wherein said arm projects a substantial distance from said pivot means and beyond said margin of the web, and said means mounting said tires comprising respective axle shafts also extending substantially beyond said web margin, and spaced bearings rotatably supporting said shafts.

5. A device according to claim 4, wherein said axle shafts are hollow, means connecting one of the ends of the shafts to the interior of the associated tire in each instance, and said means for maintaining the tires inflated including means for conducting air into the opposite ends of the shafts.

6. A device according to claim 1, wherein said biasing means comprises a pneumatic actuator attached to said arm.

7. A device according to claim 6, including means for operating said actuator and including a detector for detecting deviations of said web from a straight running path.

8. A device according to claim 1, wherein said biasing means comprise a static weight, and a flexible connection between said weight and said arm to impose the weight in a biasing direction on said arm.

9. A device according to claim 1, wherein said means mounting said tires comprise axle shafts extending away from said margin of the web, bearings mounted on said arm and supporting said axle shafts and said supporting structure providing means protecting said bearings from water splashed in the running of the web.

10. A device according to claim 1, including means for producing a tire cooling and web cleaning water shower on the margin of the web upstream from said tires having regard to the direction of running of the web.

11. A device according to claim 1, wherein said tire treads are smooth.

12. In a web spreading and guiding assembly to maintain a running paper sheet making web comprising a foraminous wire or a pickup felt spread and straight running in a papermaking machine:

a first spreading and guiding device mounted to act upon one margin of the web;

a second web spreading and guiding device mounted to act upon the opposite margin of the web;

each of said devices comprising a pair of rotary tires;

each said pair of tires being in nip relation to one another and engaging the associated web margin in the nip;

means mounting said tires to permit web spreading and guiding relative orientation of the tires of the devices;

means biasing the nipped tires of the first device to effect a spreading action to draw the web toward said first device;

and means including a web edge sensing control system for adjusting the attitude of the nipped tires of said second device to counteract the bias of the nipped tires of the first device whereby to accomplish straight running of the web and to simultaneously spread the web by virtue of the opposite transverse forces exerted by the nipped tires of the devices.

13. An assembly according to claim 12, wherein said biasing means of the first device comprise static weight means attached to mounting means for the tires of the first device, and said means for adjusting attitude of the tires of said second device including a pneumatic actuator connected to mounting means for the tires of said second device.

14. An assembly according to claim 12, wherein said means for adjusting the attitude of the tires of the second device comprise a web shift detector.

15. An assembly according to claim 12, including means to prevent said tires from toeing in relative to the associated margins of the web.

16. An assembly according to claim 12, wherein said pairs of tires are adapted to caster during running of the web.

17. An assembly according to claim 12, including means for applying tire cooling and web cleaning showers to the web margins upstream from the tires having regard to the direction of running of the web.

* * * * *